US005356133A

United States Patent [19]

Bellagamba

[11] Patent Number: 5,356,133

[45] Date of Patent: Oct. 18, 1994

[54] GOLF BALL POSITION MARKER

[76] Inventor: Miro D. Bellagamba, 5161 Vineland Rd., Orlando, Fla. 32811

[21] Appl. No.: 93,465

[22] Filed: Jul. 19, 1993

[51] Int. Cl.[5] ..... A63B 57/00

[52] U.S. Cl. ..... 273/32 A

[58] Field of Search ..... 273/32 A, 32 R, 32 B, 273/32 H; D21/234

[56] References Cited

U.S. PATENT DOCUMENTS

| | | | |
|---|---|---|---|
| D. 198,037 | 4/1964 | Thayer | D21/234 |
| D. 253,788 | 12/1979 | Kralevich | D21/234 |
| D. 332,816 | 1/1993 | Tarver | D21/234 |
| 1,735,736 | 11/1929 | Davidson | 273/32 A |
| 3,041,071 | 6/1961 | Fialon | 273/32 A |
| 3,938,805 | 2/1976 | Sakuma | 273/32 A |
| 4,007,928 | 2/1977 | Doubt | 273/32 A |
| 4,521,018 | 6/1985 | Cotchonis | 273/32 A |

FOREIGN PATENT DOCUMENTS

| | | | |
|---|---|---|---|
| 2202752 | 10/1988 | United Kingdom | 273/32 A |

*Primary Examiner*—George J. Marlo
*Attorney, Agent, or Firm*—William M. Hobby, III

[57] ABSTRACT

A golf ball marker includes a flat piece of material having top and bottom sides and an edge therearound. The edge has a concave arcuate portion shaped to fit around a portion of a golf ball and also has a point generally centered on and opposite the concave arcuate edge portion and has surface markings formed on the top of the flat piece of material including an arcuate line spaced from and parallel to the concave arcuate edge portion and also an arrow between the center of the concave arcuate edge portion and the center of the pointer. An aperture through the ball marker is positioned in or adjacent the point formed in the edge thereof.

3 Claims, 1 Drawing Sheet

GOLF BALL POSITION MARKER

BACKGROUND OF THE INVENTION

The present invention relates to a golf ball marker and especially to a golf ball marker having an arcuate edge for positioning around a golf ball.

In playing the game of golf, the golfer is allowed to lift the golf ball from the surface of a putting green for cleaning of the ball and to keep it from being a distraction or obstruction to other golfers. A lifted ball must, however, be marked to assure that when it is replaced it will be returned to the same spot from which it was lifted. Not only do the rules of golf permit such ball removal, it is the common practice and courtesy for a golfer to remove and mark a ball and replace it when it becomes his turn to putt. A ball marker must, however, be placed immediately behind the ball except if the mark is placed so that it would interfere with the play, stance, or stroke of another golfer, it should then be placed one or more putter lengths to one side. As a result of this common practice, many golfers carry a ball marker in their pocket and some simply employ a coin, such as a dime, for this purpose. A great variety of specialized ball markers have also been suggested and used. The most common ball marker being used is a disk about the size of a dime with a peg or prong extending axially from of the planar surfaces of the disk shaped body. In using a ball marker of the usual type, a golfer laterally moves the marker to a position approximate and at least partially under the ball to insure that he does not violate the provisions of the rules relating to placing the marker immediately behind the ball. When in this position, a golfer then presses down on the ball marker to cause the peg to penetrate the surface of the putting green and thereby positively locate the marker. This same basic marker locating technique is employed when a coin is used and even though the coin does not have an axial peg, most golfers will press the coin down into the grass to make sure it is lying flat and that it won't be moved by the grass or present an obstruction should another golfer's ball pass over the marker when it is being putted.

Prior art U.S. patents which show golf ball markers can be seen in the Cotchonis patent, U.S. Pat. No. 4,521,018, which is for a golf ball position marker for a golf ball that is to be lifted from the surface of the putting green and has a thin planar body defining an opening of at least semi-circular configuration and size so that the marker can be dropped vertically over the golf ball onto the surface of the putting green. The Fialon patent, U.S. Pat. No. 3,041,071, is a golf ball position marker in which a circular ring has a pointed prong extending from the center and bottom of the ring which can be pushed into the earth for marking the ball position. The Sakuma patent, U.S. Pat. No. 3,938,805, shows a golf accessory in which a circular golf ball marker is disk-shaped and includes VELCRO fastening material for retaining the marker.

The present invention is for a ball marker which can be conveniently carried on a key chain by a golfer and which includes a marker that can be placed partially around the golf ball by sliding it up to the golf ball rather than over the golf ball and can be easily viewed by parallel markers to the golf ball contact edge and includes means for marking and remarking with a pointed edge formed directly opposite to the concave ball engaging edge. The ball marker of this type can advantageously be inexpensively made and can be used in connection with corporation or golf club logos and advertising material and can have marking and remarking guidelines formed on the surface.

SUMMARY OF THE INVENTION

A golf ball marker includes a flat piece of material having top and bottom sides and an edge therearound. The edge has a concave arcuate portion shaped to fit around a portion of a golf ball and also has a point generally centered on and opposite the concave arcuate edge portion and has surface markings formed on the top of the flat piece of material including an arcuate line spaced from and parallel to the concave arcuate edge portion and has an arrow between the center of the concave arcuate edge portion and the center of the pointer. An aperture through the ball marker is positioned in or adjacent the point formed in the edge thereof.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
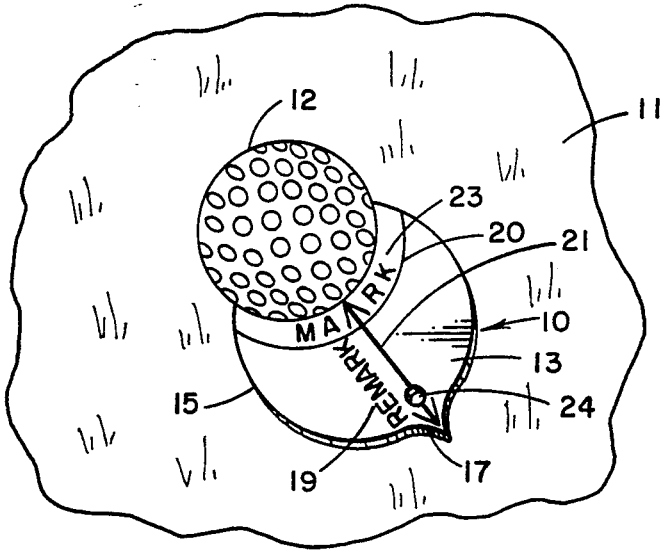
FIG. 1 is a perspective view of a golf ball marker in accordance with the present invention placed on a green with golf ball.
Figure 3:
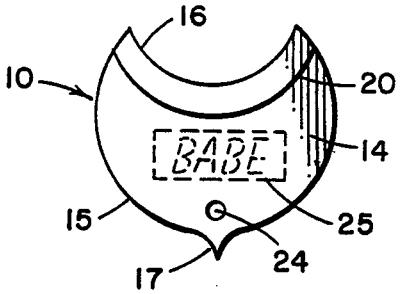
FIG. 3 is a bottom elevation showing logo material formed on the surface thereof.
Figure 2:
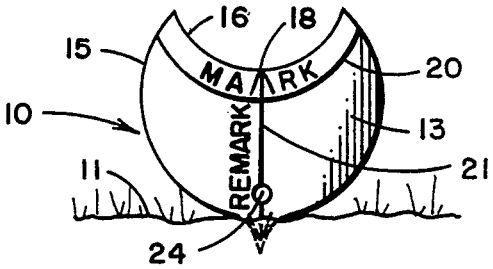
FIG. 2 is a side elevation of a golf ball marker of FIG. 1 with the point stuck in the earth.

Referring to the drawings and especially to FIGS. 1–3, a golf ball marker 10 is shown placed on a golf green surface 11 adjacent a golf ball 12. The golf ball marker is made of a flat planar piece of material, such as a metal or plastic sheeting, and has a top 13, a bottom 14, and an edge 15. The edge portion has a concave arcuate edge portion 16 shaped to fit around a golf ball 12, as shown in FIG. 1, such that it can be slid up to the golf ball and be in contact with a portion of the surface of the golf ball. The edge 15 also has a point 17 which is aligned with the center 18 of the concave arcuate surface 16 for use in marking the ball, such as in FIG. 2, by inserting the point 17 into the earth and which can also be used as a pointer. The top surface of the golf ball marker 10 can have an arcuate line 20 parallel to and spaced from the concave arcuate surface 16 such that when the surface 16 is pushed against a golf ball, it can be easily aligned with the golf ball from above where the edge 16 would otherwise be hidden from the view of the golfer. Within the surface between these parallel lines can be placed indicia, such as the word "MARK", to indicate this surface is used to mark the golf ball's position. An arrow 21 runs between this center position 18 of the arcuate surface 16 and the point 17 of a golf ball marker and can have the word "REMARK" 19 thereon to distinguish it from "MARK" 23 printed around the arcuate surface to show that the arrow can be used to remark the ball position. The golf ball marker 10 can also have an aperture 24 therethrough in the area adjacent the point 17 such that the golf ball marker can easily be placed on a key chain or the like for quick access by the golfer. The reverse side of a golf ball marker 10 can be seen in FIG. 3 in which a company, tournament, or golf club logo or other advertising material 25 can be placed thereon so that the ball marker can be used as a give-away type item. The golf ball is being shown as "marked" in FIG. 1 and as "remarked" in FIG. 2.

Figure 4:
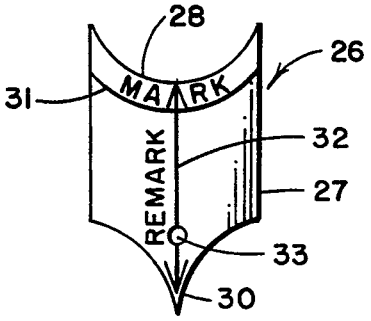
FIG. 4 is a top plan view of a second embodiment of a golf ball marker.

Turning now to FIG. 4, a second embodiment of a golf ball marker 26 has a generally squared off arrow shaped planar material 27 having a concave arcuate surface 28 formed on one end of the square and a point 30 formed on the other end thereof. This embodiment also has the second arcuate guideline 31 and the "remark" arrow 32 thereon and an aperture 33 but otherwise works in the same manner as shown in FIG. 1.

Figure 5:
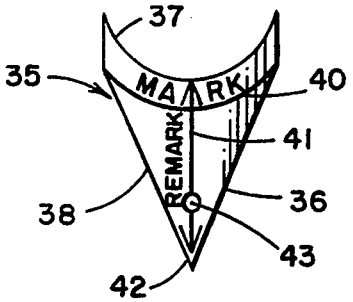
FIG. 5 is a third embodiment of a golf ball marker in accordance with the present invention.

Turning to FIG. 5, a ball marker 35 is shown having a flat planar material in a generally triangular shape 36 having the arcuate surface 37 on one end and the triangular shape forming a point 38 for the entire ball marker. This embodiment also has a parallel arcuate line 40 parallel to the concave arcuate surface 37 and a "remark" arrow 41 also positioned between the center of the arcuate surface 37 and the tip 42 of the pointed portion 38. An aperture 43 is also formed through the ball marker 35.

It should be clear at this point that a multipurpose ball marker has been provided which can be used to mark the ball and to remark it and which can advantageously be used in advertising or specialty items and which conveniently includes markings for easy visibility and directions on the top surface thereof. However, the present invention is not to be construed as limited to the forms shown which are to be considered illustrative rather than restrictive.

I claim:

1. A golf ball marker comprising:

a flat piece of material having top and bottom sides and an edge therearound, said edge having a concave arcuate portion shaped to fit around a portion of a golf ball and said edge also forming a point generally centered on and opposite said concave arcuate edge portion, and said flat piece of material having surface markings formed on the top side thereof, said surface markings including indicia and an arrow between the center of said concave arcuate edge portion and the center of said pointer, whereby a golf ball marker can be used to mark a ball position and as a pointer.

2. A golf ball marker in accordance with claim 1 in which said flat piece of material has a aperture therethrough whereby said ball marker can be carried on a keychain or the like.

3. A golf ball marker in accordance with claim 1 in which said flat piece of material top side surface markings includes an arcuate line spaced from and parallel to said concave arcuate edge portion whereby a golf ball can be easily positioned.

* * * * *